United States Patent [19]

Bollinger et al.

[11] 3,957,481

[45] May 18, 1976

[54] HERBICIDAL MIXTURE OF TERBUTRYN AND METOBROMURON

[75] Inventors: Jack Bollinger, Montpellier; Jean-Pierre Pigot, St. Germain-en-Laye; Jean Vial, Fontenay-le-Fleury, all of France

[73] Assignee: Ciba-Geigy Corporation, Ardsley, N.Y.

[22] Filed: June 11, 1973

[21] Appl. No.: 369,041

[30] Foreign Application Priority Data

June 9, 1972 France ..... 72.20802

[52] U.S. Cl. ..... 71/93; 71/120

[51] Int. Cl.[2] ..... A01N 9/22

[58] Field of Search ..... 71/93, 120

[56] References Cited

UNITED STATES PATENTS

| | | | |
|---|---|---|---|
| 3,022,150 | 2/1962 | Weed | 71/93 |
| 3,492,110 | 1/1970 | Hood et al. | 71/93 |
| 3,692,911 | 9/1972 | Martin et al. | 71/120 |

OTHER PUBLICATIONS

Patterson, "Terbutryn–A New Triazine Herbicide etc.," (1969) CA73, No. 130013z (1970).

Fricke, "Evaluation of Herbicides for Annual Weed Control etc.," (1971) CA76, No. 109,122 (1972).

*Primary Examiner*—Glennon H. Hollrah

*Attorney, Agent, or Firm*—Frederick H. Rabin; Harry Falber

[57] ABSTRACT

The present invention discloses a synergistic herbicidal mixture for controlling weeds in cultures of leguminosae and solana, especially potatoes, which contains as active ingredient a mixture of 2-methylthio-4-ethylamino-6-tert. butylamino-s-triazine and of N-p-bromophenyl-N′-methyl-N′-methoxy urea.

4 Claims, No Drawings

HERBICIDAL MIXTURE OF TERBUTRYN AND METOBROMURON

The present invention concerns a herbicidal mixture for controlling windsown weeds in cultures of leguminosae and solana, especially in cultures of potatoes.

It is well known, that herbicides have already been used on such cultures; among them, the potato represents one of those cultivated in countries which have a temperate climate which has been most widely treated with herbicides.

The invention described below possesses some important advantages over the solutions known up to date.

Traditionally the potato is considered as a culture which has to be weeded and is rather difficult to cultivate. It is rather sensitive to the presence of weeds and it is not rare that drops in yield of up to 30 to 50% occur when the culture is heavily infested.

The different modes of treatment are difficult to accomplish at a given amount. There is always the risk to injuring the plants (loss of yield) or retarding the moment of harvest or indeed the transmission of virus diseases. In addition such treatments are very costly in labour (man-hours). Thus, especially since 1966 when the first preventive herbicides appeared, the same replaced more and more the earlier methods of treatment and economices in man-hours of 15 to 35 hours per hectare were realised depending on the region (see IV COLUMA p. 306 T I Congress of December 1969).

The herbicides used up to now belonged to the same chemical group (substituted ureas) or similar groups.

When applied to the crop they prevent the germination of many windsown weeds during the two to three month period when the crop is largely developing a therefore likely to suffer most from competition from growing weeds. These herbicides were usually well tolerated by the crop and did not result in any lowering of the yield.

The fact that they belong to the same chemical group implies that they have an identical spectrum of activity and therefore spare a selection of weeds which are resistant thereto. These weeds then proliferate.

In V° COLUMA (Congress of December 1971 p. 40 652 T III) the following wish was expressed: "To avoid the development of a selective windsown weed flora it would be desirable to provide the farmers with more complete or at least complementary herbicides."

The present invention aims to put at the disposal of the farmers a herbicide that has a wider spectrum of activity than the products already existing, avoids a selection of weeds, diminishes work on the crops to a minimum and is compatible with the needs of the crop.

The composition according to the invention contains a mixture of two herbicidal ingredients, which have already been proposed individually for controlling weeds in culture-crops.

Both of them have a very specific activity-spectrum and the systematic use of the one or the other leads to a desequilibrium of the flora which in turn leads to the proliferation of the species which are resistant to the compound used.

In order to enlarge the activity-spectrum, the inventors have tested and combined a large number of compounds and have discovered that two among them do not only have a broader field of activity but also exhibit a synergistic effect in their activity on certain species of weeds whereby at the same time the greatest safeguard for the crop is maintained.

The main characteristic of the new herbicidal mixture is the presence of 2-methylthio-4-ethyl-6-tert. butylamino-s-triazine (I) and N-p-bromophenyl-N'-methyl-N'-methoxy urea (II), corresponding respectively to the formulae

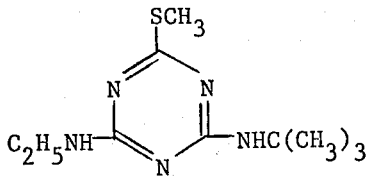

(I)

"terbutryn"

and

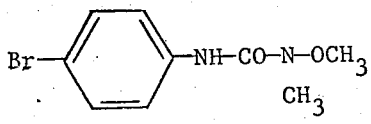

(II)

"metobromuron"

in a weight/weight ratio of compound (I) to compound (II) of from 1:2 to 2:1.

For simplification, the compounds will be herein called "terbutryn" (compound I) and "metobromuron" (compound II).

Preferred mixtures contain one part of "terbutryn" for one part of "metobromuron"; two parts of "terbutryn" for one part of "metobromuron" or one part of "terbutryn" for two parts of "metobromuron". All the intermediary ratios may also be employed.

In agricultural practice mixtures of pure active substances are rarely used, they are rather formulated to present physico-chemical properties which respond to the needs of the application technique.

The formulations most widely used are spraying powders or aqueous suspensions containing e.g. 50% of active ingredient.

In a spraying powder the active substances are mixed and ground with a wetting agent, a dispersing agent, milling adjuvants and other additives until an extremely fine mixture is obtained.

The powders preferred in this invention are very finely ground so that there is no residue when they are passed through a sieve with a mesh-diameter of 400 microns. The residue maximum should be 0,15% when they are passed through a sieve of 315 micron mesh-diameter and maximum 2% when the sieve has 44 microns mesh-diameter.

The spraying or dusting powders and the sprinkling agents which may also be granulated, are prepared by mixing and milling the active substances with the usual solid additives. Suitable additives are talcum, diatomaceous earth, kaolin, bentonite, calcium carbonate, tricalcic phosphate, sand as well as saw dust, ground cork and other material of vegetative origin. The active substances may also be applied to these additives by means of volatile solvents.

In aqeous suspensions the only solid material is the active ingredient, the other ingredients e.g. wetting agents, dispersing agents, suspensing adjuvants, antifreezing additives being liquid or in dissolvable form. A very fine grinding of the active substances (particle size having a diameter of from 1 to 10 microns with preferred size 1 to 2 microns) ensures together with the physical stabilisors properties which prevent the suspensions against sedimentation or flocculation.

The main ingredients of an aqueous suspension besides the active material are:

wetting agents, which are in general natural or synthetic surface active agents such as soaps, anionic surface active agents (alkylaryl sulfonates, alkyl sulfates and- sulfonates or -phosphates) and non-ionic agents (ethoxylated alkylphenols, fatty alcohols and synthetic alcohols ethoxilated fatty acids) as well as cationic surface active agents and ampholytes;

dispersing agents such as ligno-sulfonates of alkaline and alkaline earth metals, alkylnaphthalene sulfonates of alkaline and alkaline earth metals, condensation products of formaldehyde with naphthalene sulfonic acid and phenol;

suspending agents such as cellulose derivatives (methyl cellulose, carboxymethyl cellulose, hydroxymethyl cellulose) of high molecular weight;

polyvinyl alcohols and carboxyvinyl polymers of high molecular weight; colloidal slates of the bentonite or attapulgite kind and colloidal silicic acid.

antifreezing agents (mineral salts and alcohols of polyalcohols);

fungicides of the pentachlorophenol type, dehyroacetate or quaternary ammonium salts;

antifoaming agents such as silicone;

if necessary, the compositions according to the present invention can also contain additives which enhance their resistance to rain and sunlight. Furthermore additives which facilitate adherence to the ground and consequently penetration into the earth such as e.g. oils of vegetable, animal or mineral origin.

The following examples illustrate some application forms of the present invention but in no way limit the extent thereof. The parts are therein given by weight.

EXAMPLE 1

For the preparation of a spraying powder with 50% of active substance the following are used:

a. 50 parts of 2-methylthio-4-ethylamino-6-tert. butylamino-s-triazine
1 part of sodium polyoxyethyl oleyl sulfate
5 parts of sodium naphthol sulfonate
3,5 parts of a condensation product of formaldehyde, phenol and naphthalene sulfonic acid that is water soluble
10 parts of diatomaceous earth
kaolin to complete 100 parts b.
50 parts of N-p-bromophenyl-N′-methyl-N′-methoxy urea
1,5 parts of alkylphenol polyglycol ether
3,5 parts of sodium salt of heptadecylbenzimidazol sulfonic acid.
13 parts of silicic acid
(argile) slate powder to complete 100 parts.

The active substances are mixed with the additives and then finely milled in appropriate cylindrical mills. The spraying powders with 50% active substance give extremely stable suspension, when diluted with water. These suspensions are well suited for the pre-emergence treatment of potato cultures.

EXAMPLE 2

For the preparation of an aqueous suspension concentrate containing 500 g of active substance per liter the following is needed:

25 parts of 2-methylthio-4-ethylamino-6-tert-.butylamino-s-triazine
25 parts of N-p-bromophenyl-N′-methyl-N′-methoxy-urea
2 parts of alkylphenol polyglycol ether
1 part of calcium alkylnaphthalene sulfonate
0,1 part of fermentation-polysaccharide (from fermentation residues)
10 parts of a mineral salt or of ethylene glycol or propylene glycol
0,4 parts of sodium pentachlorophenolate
0,4 parts of antifoam silicone water to complete 100 parts The active substance which are hydrophobic are introduced by means of an appropriate solvent into the water which already contains all other ingredients except the suspending agent. The concentrate thus obtained is then ground up in a colloidal mill, a cylindrical mill, a ball mill or any equivalent mill unit the desired particle size (1 to 2 microns) is obtained. The suspending agent is then added to the concentrate. The composition thus obtained is free flowing and homogeneous with a viscosity at 20°C of between 100 and 300 centipoises.

The invention concerns also a method for controlling weeds especially in cultures of *leguminosae* and *solana*. It comprises applying to the fields a composition according to the invention containing as active substance a mixture of "terbutryn" and "metobromuron" in an amount sufficient to achieve almost complete control of the weeds.

The application of the composition containing the mixture of "terbutryn" and "metobromuron" in the defined ratio is preferably done before the emergence of the weeds and between the seeding or planting of the culture crop and their emergence.

Terbutryn is a compound of low toxicity (DL 50 p.o. rat 3800 mg/kg) which is not very soluble in water (58 ppm at 20°C). It is mainly absorbed by the roots of the plants but absorbtion by the leaves is also effective.

Monobromuron is more toxic (DL 50 p.o. rat 300 mg/kg) and more water-soluble (330 ppm at 20°C). It is equally well absorbed by the roots and by the leaves of the plants.

The inventors have discovered that the mixture of these two compounds not only widens the spectrum of activity but surprisingly that there is, in this case, a synergistic increase in the herbicidal effect upon different weeds difficult to control by one other component alone.

This synergistic effect is demonstrated by the following tests.

TEST 1

A series of 10 tests with each 2 repeats were run, whereby the effect upon the plants was observed. The test plots had an area of 27 $m^2$ and neighboring plots not treated chemically served as control. The treatment was carried out with each of the components alone as well as with the mixture. Application was made after the planting of the potatoes but before their emergence. The assessment was made according to the method known universally as the European Weed Research Conference Method (EWRC-method).

This EWRC-method was introduced in Germany in 1963 on the basis of observations of BOLLE on the evolution of parasites. MAERKS and JOHANNES worked also on this method (see DESAYMARD "Phytiatrie Phytopharmacie" 1968 Vol. 2 p. 170).

The method was conceived to measure the effect of a herbicide on the weed and on the culture crop. It consists in giving the plants a note from 1 to 9; 1 being the most favorable evaluation (maximum effect on weed, minimum phytotoxicity on culture plant).

The zone of positive evaluation is 1 to 4, the zone of negative evaluation is 6 to 9. An evaluation mark 5 may indicate, according to the circumstances (competition regeneration-ability) a favorable or negative result.

| Evaluation index | Estimation of the effect on weed | Estimation of the effect on culture plant |
|---|---|---|
| 1 | total destruction | no effect plant develops like untreated control |
| 2 | very good | very slight symptoms of damage |
| 3 | good | slight symptoms |
| 4 | sufficient in practice | damage without consequence for the yield of the crop |
| 5 | debatable | debatable |
| 6 | poor | rather bad damage |
| 7 | bad | strong damage |
| 8 | very bad | very strong damage |
| 9 | no action weed develops like untreated control | complete destruction of crop. |

It is also possible to evaluate the physical properties of a sprayable composition by means of this scale, 1 meaning optimum 9 meaning not usuable. This above evaluation does not replace other more quantitive determinations. Where possible and necessary the yield (at harvest) should also be measured. The degree of spread of the weeds is noted in percent of total surface area.

The measurements were made by comparison with the plants in the untreated control lots before the potato culture was treated mechanically (heaping the earth against the growing plant). The weeds present in these tests were mainly white goosefoot, (*Chenopodium album*), barnyard grass (*Panicum crus galli*), smartweeds (*Polygonum sp.*), wild radish (*Raphanus raphanistrum*), wild mustard (*Sinapis arvensis*).

The numbers given in the table below show the percent of weed destroyed in the different tests. For the weeds present, a mixture of 1 kg terbutryn and 1 kg metobromuron gives superior results to the action of these compounds applied at a rate of 2 kg/ha. The amount of active material used in these test is indicated as kg/ha (kilogram per hectare).

| weed | "terbutryn" (T) 2 kg/ha | "metobromuron" (M) 2 kg/ha | mixture (T)+(M) 1:1 2 kg/ha |
|---|---|---|---|
| *Chenopodium album* | 98% | 100% | 100% |
| *Panicum crus galli* | 62% | 95% | 99% |
| *Polygonum sp.* | 77% | 95% | 100% |
| *Raphanus raph.* | 86% | 92% | 95% |
| *Sinapis alba* | 95% | 95% | 100% |

The synergistic effect becomes more apparent when the evaluation marks of the ERWC-method are used for each test than on these average-values. Further, it is to be noted that an increase in effect from 95 to 99 or 100% is much harder to obtain and represents a greater improvement than for instance an increase in effect from 70 to 80%.

Test 2

In a test plot of a potato field near the town of Tierce (France) the weed *Sinapis sp.* was controlled as follows:

| active substance amount applied | evaluation note | degree of destruction of Sinapis sp. | | |
|---|---|---|---|---|
| "terbutryn" 2 kg/ha | 7 | 32% | | |
| "metobromuron" 2 kg/ha | 4 | | 90% | |
| mixture 1:1 (T)+(M) 2 kg/ha | | | | 100% |
| Increase in effect of the mixture | | +68% | +10% | — |

The capability of the mixture towards the crop is better when used in the same application amount of 2 kg/ha or even at a double dose of 4 kg/ha than that of its individual components.

In 10 tests it has been observed that the mixture, when used at a double dose of 4 kg per hectare is as well tolerated as the components alone at the same dose in 6 cases; in 2 cases it was better tolerated than terbutryn alone and in 2 cases than metobromuron alone.

Test 3

Place: Tierce (France); crop: potato
Composition of soil: clay 5,3% humus 14,4%
Sand 80%; application: pre-emergence

| active substance | Panicum crus galli 2 kg/ha | Sinapis alba 2 kg/ha | Raphanus raph. 2 kg/ha | Raphanus raph. 4 kg/ha |
|---|---|---|---|---|
| "terbutryn" | 50% | 55% | 55% | 55% |

-continued

| active substance | | Panicum crus galli 2 kg/ha | | | Sinapis alba 2 kg/ha | | | Raphanus raph. 2 kg/ha | | | Raphanus raph. 4 kg/ha | |
|---|---|---|---|---|---|---|---|---|---|---|---|---|
| "metobromuron" | | 90% | | | 95% | | | 95% | | | 90% | |
| mixture 1:1 (T)+(M) | | | 100% | | | 100% | | | 100% | | | 100% |
| Increase in effect of the mixture | +45% | +10% | — | +45% | +5% | — | +45% | +5% | — | +45% | +10% | — |

Test 4

Place: St. Ouen (France); crop: potato, application pre-emergence

| active substance | Chenopodium album | | | Polygonum sp. | | |
|---|---|---|---|---|---|---|
| "terbutryn" 2 kg/ha | 53% | | | 55% | | |
| "metobromuron" 2 kg/ha | | 98% | | | 95% | |
| mixture 1:1 (T)+(M) 2 kg/ha | | | 100% | | | 100% |
| Increase in effect of the mixture | +45% | +2% | — | +45% | +5% | — |

Test 5

Place: Merznes (France); crop: potato

Composition of soil: clay 14,2% humus 24,9% sand 46% organic material 1,74%; application: pre-emergence

| active substance | solanum nignum | | |
|---|---|---|---|
| "terbutryn" 2 kg/ha | 95% | | |
| "metobromuron" 2 kg/ha | | 95% | |
| mixture 1:1 (T)+(M) 2 kg/ha | | | 95% |
| Increase in effect of the mixture | +2,5% | +2,5% | — |

Test 6

Place: Soucelles (France); crop: potato

Composition of soil: clay 6% humus 23,4% sand 70,6%

PH 5,2 organic material 3,64%;

application: pre-emergence

| active substance | Polygonum pers. | | | Sinapis alba | | | Sinapis arvensis | | |
|---|---|---|---|---|---|---|---|---|---|
| "terbutryn" 2 kg/ha | 70% | | | 70% | | | 70% | | |
| "metobromuron" 2 kg/ha | | 55% | | | 70% | | | 70% | |
| mixture 1:1 (T)+(M) 2 kg/ha | | | 95% | | | 95% | | | 95% |
| Increase in effect of the mixture | +25% | +40% | — | +25% | +25% | — | +25% | +25% | — |

The amount of formulated active substance to be applied in the compositions of this invention is from 2 to 8 kilogram per hectare. For solanum-cultures, especially potatoes, the preferred mixture is 1:1 (terbutryn: metobromuron) and the amount applied 4 kg/ha. If the soil is light and not rich in humus the amount to be applied can be reduced to 3 kg/ha, in heavy, humus-rich soils 5 kg/ha recommended.

The herbicide is best applied by means of a sprayer. In order to obtain an optimal distribution and the best fixation to the ground, the composition should be applied with an amount of water from 400 to 1000 l per hectare.

The application of the herbicide is preferably carried out after seeding or planting of the crop and before it's emergence. With cultures that have to be replanted, like tomatoes or egg-plants (aubergines) treatment is done before replanting. With the potato, the treatment is done on the seed-potato - "ridges" or on the level field according to the local cultivation technique and the variety of potato.

Another advantage of the compositions of this invention is that they are adaptable to the different techniques of cultivating potatoes. The farmer may leave the crop area unattended after the chemical treatment, he may heap the earth around the plants once they have emerged 15 to 20 cm or he may heap the earth several times around the plants during their growth. Thanks to the different solubilities the two components ensure the mixture of a long lasting activity, which is superior to the effect each component alone would have.

Under normal circumstances e.g. when there is too much rain, composition based on metobromuron alone wash away and give a too weak action, while, when there is a drought, terbutryn show an irregular action. For this reason the compositions according to the present invention show even in the extreme climatic circumstances occurring practice not only a good and regular action but also a synergistic increase in activity. This is achieved by an optimal distribution of the herbicidally active components in the parts of the soil where the weeds germinate.

We claim:

1. A herbicidal composition for controlling weeds in crop plants which consists essentially of 2-methylthio-4-ethylamino-6-tert.butylamino-s-triazine and N-(p-bromophenyl)-N'-methyl-N'-methoxy urea in substantially equal amounts by weight.

2. A method for controlling weeds in crop cultures which comprises applying to said cultures, prior to emergence of the crop, a herbicidally effective amount of a composition comprising substantially equal amounts by weight of 2-methylthio-4-ethylamino-6-tert.butylamino-s-triazine and N-(p-bromophenyl)-N'- methyl-N′-methoxy urea.

3. A method according to Claim 2 in which the herbicidal composition is applied at the rate of from 2 to 4 kilograms of active substances per hectare.

4. A method according to Claim 2 in which the crop culture is potatoes.

* * * * *